US006210529B1

(12) United States Patent
Huhtelin

(10) Patent No.: US 6,210,529 B1
(45) Date of Patent: Apr. 3, 2001

(54) METHOD FOR REGULATING THE SURFACE LEVEL AND CONSISTENCY IN A TANK FOR METERING COMPONENT STOCK

(75) Inventor: Taisto Huhtelin, Tampere (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/329,767

(22) Filed: Jun. 10, 1999

(30) Foreign Application Priority Data

Jun. 10, 1998 (FI) ..... 981328

(51) Int. Cl.[7] ..... D21F 1/08
(52) U.S. Cl. ..... 162/198; 162/263; 162/264
(58) Field of Search ..... 162/49, 254, 263, 162/198, 264

(56) References Cited

FOREIGN PATENT DOCUMENTS 981327 6/1998 (FI) .
981329 6/1998 (FI) .

*Primary Examiner*—Dean T. Nguyen
(74) *Attorney, Agent, or Firm*—Steinberg & Raskin, P.C.

(57) ABSTRACT

Method for regulating the surface level and the consistency in a stock chest for metering of a component stock. Stock is fed as an outward flow out of the bottom portion of a storage tower by a first pump into the stock chest. Into this outward flow, a first dilution water flow is passed in order to regulate the consistency of the stock fed into the stock chest to a—desired level. The stock is fed as a metering flow from the stock chest by a second pump into the short circulation of the paper or board machine. The surface level in the stock chest is maintained constant by an overflow passed from the stock chest (20) into a pumping tank. From the pumping tank, stock is fed as a return flow by a third pump into the bottom portion of the storage tower. A second dilution water flow is passed into this return flow to thereby regulate the consistency in the bottom portion of the storage tower to a desired level. The stock is stirred in the bottom portion of the storage tower and in the stock chest in order to provide a uniform consistency.

29 Claims, 5 Drawing Sheets

METHOD FOR REGULATING THE SURFACE LEVEL AND CONSISTENCY IN A TANK FOR METERING COMPONENT STOCK

FIELD OF THE INVENTION

The present invention relates to a method for regulating the surface level and consistency in a stock chest for metering a component stock wherein the component stock is fed as an outward flow out of the bottom portion of a storage tower by a pump into the stock chest, a first dilution water flow is passed into the outward flow to thereby regulate the consistency of the component stock fed into the stock chest to a desired level, the component stock is stirred in the stock chest in order to obtain a uniform consistency and the component stock is then fed as a metering flow from the stock chest by another pump into the short circulation of the paper or board machine.

BACKGROUND OF THE INVENTION

Regarding its principal features, the stock feed at a paper machine is generally as follows. The stock components are stored at the paper mill in separate storage towers. From the storage towers, the stocks are fed into stock chests, and from the stock chests further into a common blend chest, in which the stock components are mixed with each other. From the blend chest, the stock is fed into a machine chest, and from the machine chest there is an overflow back into the blend chest.

From the machine chest, the stock is fed into a dilution part of the wire pit, in which the stock is diluted with white water recovered from the wire section and serving as dilution water. From the wire pit, the stock is fed through one or more centrifugal cleaners into a deaeration tank. From the deaeration tank, stock free from air is fed through a machine screen into the headbox, i.e., into the inlet header thereof, and through the slice opening of the headbox to the wire section. A bypass flow of the headbox is fed back into the deaeration tank, and the white water recovered from the wire section is fed into the wire pit.

The basis weight and the ash content of the paper are measured on-line right before reeling from a ready, dry paper, usually by means of measurement apparatuses based on beta radiation and x-radiation. Based on this measurement, the basis weight of the paper is regulated, for example, by means of a so-called basis weight valve by whose means the stock flow after the machine chest is controlled. A second possibility is regulation of the speed of rotation of the pump that feeds stock from the machine chest into the wire pit. The ash content is controlled by dosing of fillers. The basis weight profile of the paper in the cross direction is obtained when the measurement apparatus is installed to move back and forth across the web.

OBJECTS AND SUMMARY OF THE INVENTION

It is an object of the present invention to provide a new and improved method for regulating the surface level and consistency in a stock chest for metering a component stock.

It is another object of the present invention to provide a method for regulating the surface level and consistency in a stock chest for metering a component stock in which attempts are made to maintain a substantially constant surface level in the stock chest constantly and to maintain the stock constantly at the desired constant consistency throughout the entire stock chest.

In order to achieve these objects and others, a method for regulating a surface level and consistency of stock in a stock chest in accordance with the invention comprises the steps of directing a flow of component stock from a bottom portion of a storage tower into the stock chest, directing a first flow of dilution water into the flow of component stock before the flow of component stock enters into the stock chest to mix with the component stock, controlling the surface level of stock in the stock chest by directing an adjustable amount of stock removed from the stock chest as a return flow into the bottom portion of the storage tower to mix with the component stock in the storage tower, and regulating the consistency of the component stock in the bottom portion of the storage tower by directing a variable second flow of dilution water into the return flow of stock from the stock chest. The component stock in the bottom portion of the storage tower is preferably mixed to thereby provide the component stock with a uniform consistency in the bottom portion of the storage tower.

To control the surface level in the stock chest, a pumping tank may be arranged to receive overflow from the stock chest, and the adjustable amount of stock pumped from the pumping tank into the storage tower via a pump. The surface level in the stock chest may be controlled to be substantially constant.

The flow of component stock may be directed from the bottom portion of the storage tower in the stock chest by passing the component stock from the bottom portion of the storage tower into an outlet line, and arranging a pump to receive the component stock from the outlet line and direct the component stock through a feed line into the stock chest. The first flow of dilution water is thus directed into the outlet line.

In some embodiments, the consistency of the mixed component stock and first flow of dilution water is measured before the stock chest and the first flow of dilution water being directed into the flow of component stock is regulated, e.g., its flow rate or quantity, based on the measured consistency.

A pump may be arranged to direct the mixed flow of component stock and first flow of dilution water into the stock chest, the consistency of the mixed flow of component stock and first flow of dilution water measured after the pump and before the stock chest and a flow property of the mixed first flow of component stock and first flow of dilution water, e.g., flow rate or quantity, measured after the pump and before the stock chest. A flow property of the first flow of dilution water is also measured before the first flow of dilution water is directed into the flow of component stock, and then, the first flow of dilution water being directed into the flow of component stock may be regulated based on the measured consistency and flow property of the mixed flow of component stock and first flow of dilution water and the measured flow property of the first flow of dilution water.

In another embodiment, a flow property of the first flow of dilution water is measured before the first flow of dilution water is directed into the flow of component stock, and the first flow of dilution water into the flow of component stock is regulated based at least in part thereon. A pump can be arranged to pump stock from the stock chest to a short circulation of a paper machine and the flow of the stock being pumped from the stock chest measured. The second flow of dilution water can then be regulated based on the measured flow property of the first flow of dilution water and the measured flow property of the stock being pumped from the stock chest to the short circulation of the paper machine.

Optionally, the second flow of dilution water is also regulated in consideration of any difference between an amount of water in the stock being pumped from the stock chest to the short circulation of the paper machine and an amount of water entering into the stock chest in the mixed flow of component stock and first flow of dilution water.

In another embodiment, a pump pumps stock from the stock chest to the short circulation of a paper or board machine and this flow of the stock is measured. The flow of component stock from the bottom portion of the storage tower is regulated to be larger than the measured flow of stock from the stock chest by a substantially constant amount. Optionally, a flow property of the return flow is measured and the flow of stock from the storage tower is regulated by a flow controller in accordance with a set value based on the measured flow of stock from the stock chest to the short circulation of the paper machine and the measured flow property of the return flow.

In yet another embodiment, the surface level of stock in the stock chest is controlled by arranging a pumping tank to receive overflow from the stock chest, the return flow of stock from the stock chest being directed from the pumping tank into the storage tower, measuring the surface level of stock in the pumping tank, and regulating the return flow of stock from the pumping tank into the bottom portion of the storage tower based on the measured surface level of stock in the pumping tank such that the surface level of stock in the pumping tank is maintained substantially constant. Optionally, a pumping tank is arranged to receive overflow from the stock chest, the return flow of stock from the stock chest being directed from the pumping tank into the storage tower and the return flow of stock from the pumping tank into the bottom portion of the storage tower regulated by means of a flow controller in accordance with a set value based on the measured surface level of stock in the pumping tank such that when the surface level of stock in the pumping tank rises, the return flow increases and when the surface level of stock in the pumping tank decreases, the return flow is reduced.

In process solutions in which a blend chest/machine chest arrangement is not employed, the component stocks are fed directly into a mixing volume placed in the main line of the process. In such a case, it is required that, in the component-stock stock chest, there is a constant consistency and a constant pressure all the time. By means of the method in accordance with the present invention, a constant consistency and a constant pressure are reliably obtained in the stock chest.

The method in accordance with the invention can also be used in conventional process arrangements for stock feed in which a blend chest/machine chest arrangement is used.

With respect to a novel process arrangement related to the method in accordance with the present invention, reference is made to the current assignee's Finnish Patent Application No. 981327.

With respect to regulating the basis weight applicable in the novel process arrangement related to the method in accordance with the present invention, reference is made to the current assignee's Finnish Patent Application No. 981329.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
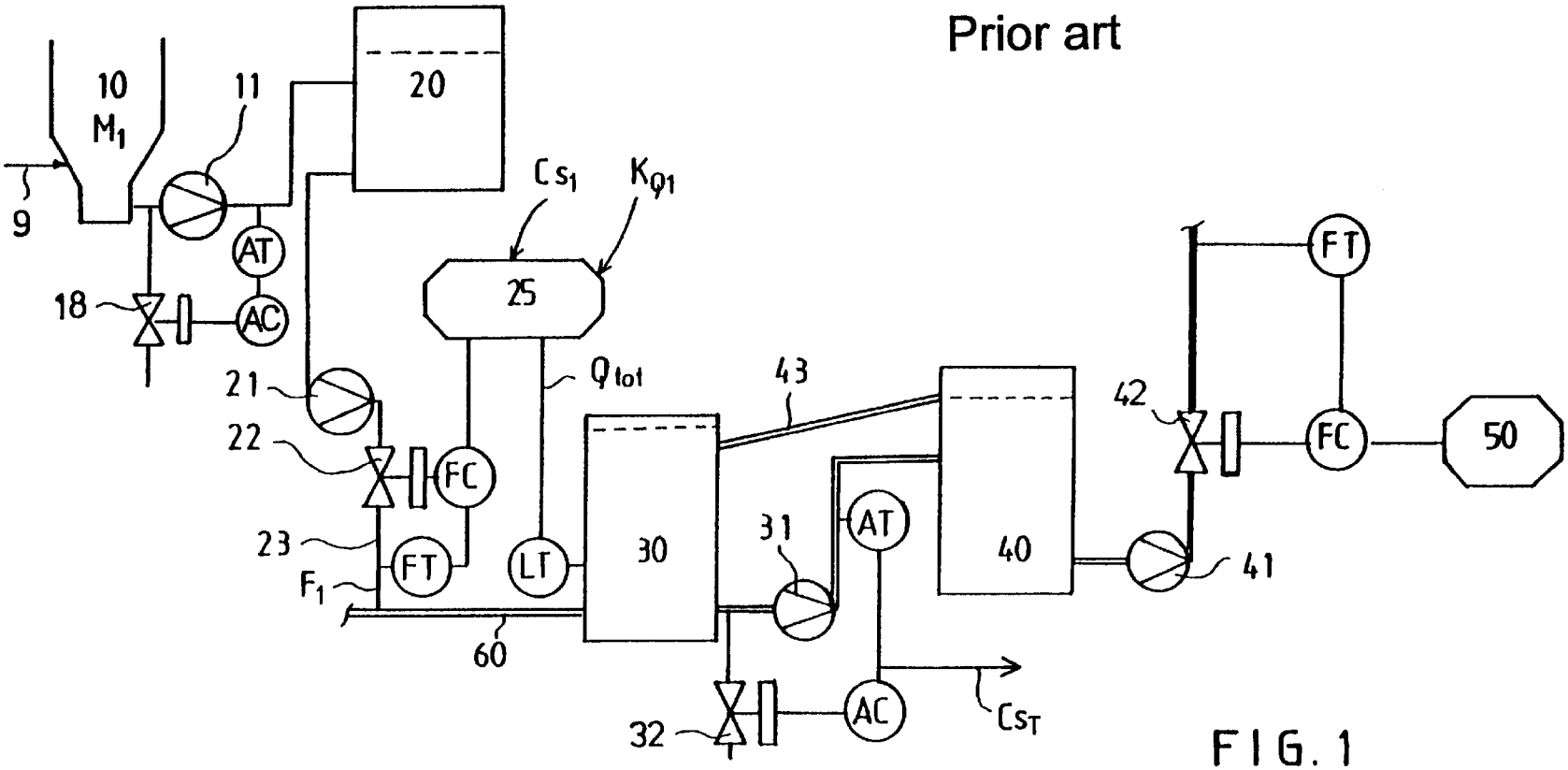
FIG. 1 is a schematic illustration of a conventional process arrangement for the feed of stock in a paper machine, in connection with which arrangement it is possible to use the method in accordance with the present invention for keeping the surface level and the consistency in a stock chest at constant values.

Referring to FIGS. 1–5 wherein like reference numerals refer to the same or similar elements, FIG. 1 is a schematic illustration of a conventional prior art process arrangement of the stock feed in a paper machine. Only one component stock is shown in FIG. 1 and the recovery of fibers, the regulation of the flow of the component stock, or the regulation of the surface level in the stock chest of the component stock have not been illustrated.

In FIG. 1, a component stock $M_1$ is fed from a storage tower 10 by means of a first pump 11 into a stock chest 20. A dilution water flow is passed through a regulation valve 18 to mix with the component stock before a first pump 11. Further, the component stock is diluted in the bottom portion of the storage tower 10 by means of a dilution water flow 9 passed to the bottom portion. From the stock chest 20, the component stock $M_1$ is directed by means of a second pump 21 through a regulation valve 22 and through a feed pipe 23 to a main line 60 of the process, which passes into a blend chest 30. From the blend chest 30, the stock is directed by means of a third pump 31 into a machine chest 40. From the machine chest 40, the machine stock $M_T$ is fed by means of a fourth pump 41, through a second regulation valve 42, into the short circulation. Moreover, from the machine chest 40, there is an overflow 43 passing back to the blend chest 30. The blend chest 30 and the machine chest 40 form a stock equalizing unit, and in them the stock is diluted to the ultimate metering consistency. Further, by their means, uniform metering of the machine stock is enabled.

The metering of the component stocks $M_i$ into the blend chest 30 takes place so that attempts are made constantly to keep a substantially constant surface level in the blend chest 30. Based on changes in the surface level in the blend chest 30, which changes are measured by a surface level detector LT, the surface level controller computes the total requirement $Q_{tot}$ of stock to be metered, which information is fed to the component stock metering-control block 25. Also, a pre-determined stock proportion value $K_{Qi}$ of the component stock $M_i$ and a consistency value $Cs_i$ of the component stock $M_i$ are fed to the metering-control block 25.

Based on the total requirement $Q_{tot}$ of stock $M_T$ and the pre-determined proportions $K_{Qi}$ of component stocks, the metering-control block 25 computes the requirement $Q_i$ of feed of component stock. Based on the component stock feed requirement $Q_i$ and on the data $Cs_i$ on the consistency of the component stock $M_i$, the component stock metering-control block 25 computes the flow target $F_i$ of the component stock $M_i$. Based on this flow target $F_i$, the regulation valve 22 is controlled so as to produce the flow $F_i$ into the blend chest 30. The flow $F_i$ of the component stock $M_i$ is also measured constantly by means of a flow detector FT, whose measurement signal is fed through the flow controller FC to the component stock control valve 22.

From the blend chest 30, the stock is fed at a substantially constant flow velocity by means of the third pump 31 into the machine chest 40. At this pumping stage, the consistency of the stock is also regulated to the desired target consistency of the machine chest. This is accomplished by means of dilution water, which is fed through the regulation valve 32 to the outlet of the blend chest 30 to the suction side of the third pump 31. By means of the dilution water, the stock present in the blend chest 30, which is typically at a consistency of about 3.2%, is diluted to the ultimate metering consistency of about 3%. To the dilution water regulation valve 32, the metering signal of a consistency detector AT is directed, which detector AT is connected to the pressure side of the pump 31. The measurement signal $Cs_T$ of the consistency detector AT, measured either after the third pump 31 or after the fourth pump 41, is passed to a basis weight controller 50.

The regulation of the basis weight takes place so that the basis weight controller 50 controls the regulation valve 42 placed after the fourth pump 41. By means of this regulation valve 42, the flow of the stock to be fed into the short circulation is regulated, which flow affects the basis weight of the paper web obtained from the paper machine. When the flow is increased, the basis weight becomes higher, and when the flow is reduced, the basis weight becomes lower.

In the basis weight controller 50, changes in the machine speed, and possibly also changes in the consistency of the machine stock, changes in metering of ashes, and changes in retention are taken into account. Based on these parameters, the basis weight regulation computes a target value for the flow of machine stock.

In prior art arrangements, generally it is assumed that, from the area of the short circulation, no disturbance comes that affects the basis weight of the paper web. In this connection, it is also assumed that, in the operation of the centrifugal cleaners, the deaeration tank, and of the machine screen, no such changes occur as a result of which stock components of the machine stock would depart from the process. Likewise, it is assumed that the consistency of the dilution water pumped from the wire pit remains substantially constant.

Figure 2:
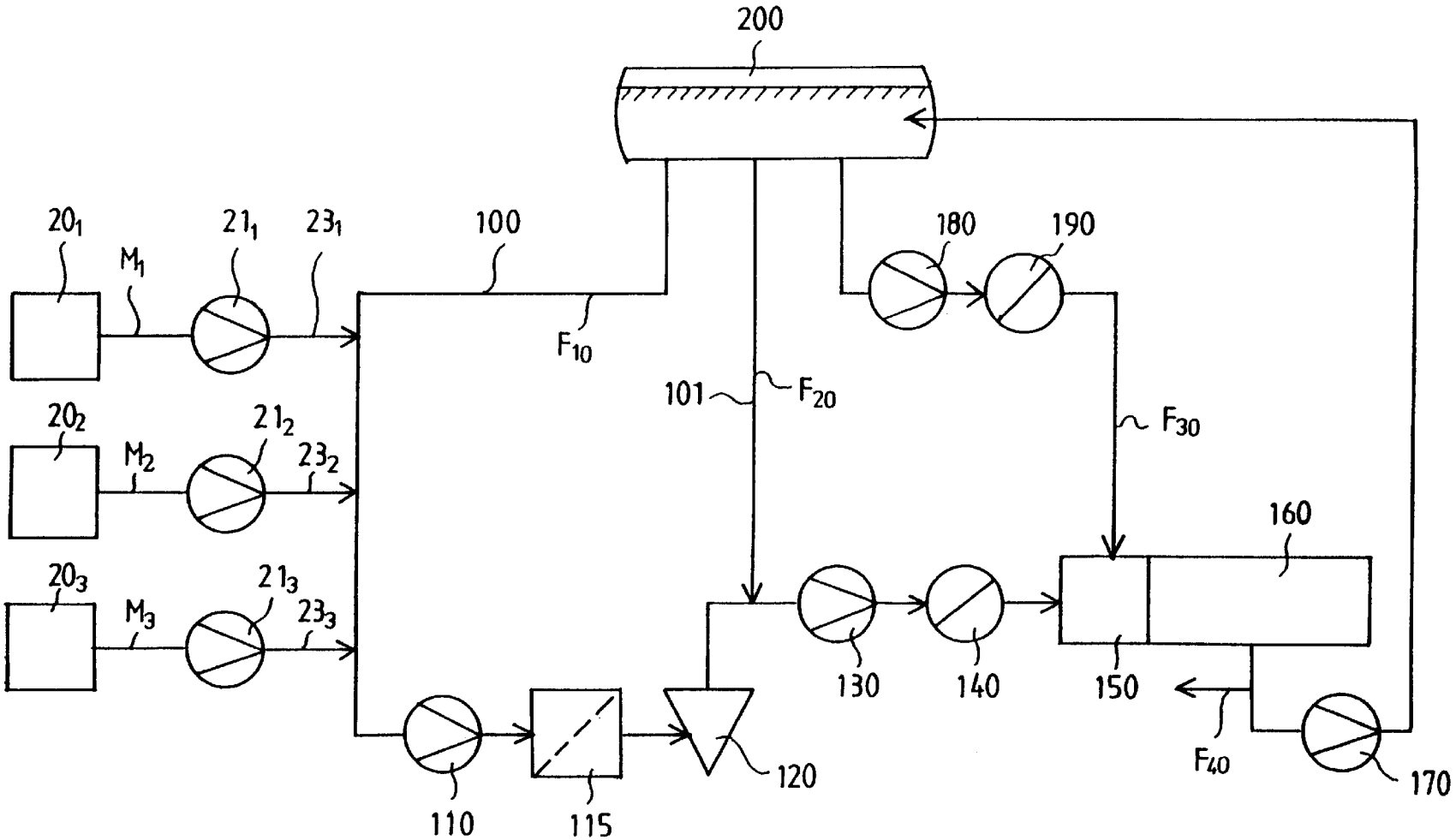
FIG. 2 is a schematic illustration of a second process arrangement for the feed of stock in a paper machine, in which the method in accordance with the present invention for keeping the surface level and the consistency in a stock chest at constant values can be applied.

FIG. 2 is a schematic illustration of a second process arrangement for the feed of component stocks, in which it is possible to apply the method in accordance with the invention for keeping the surface level and the consistency in the stock chest at constant levels.

In FIG. 2, each component stock $M_i$ is fed from a respective stock chest $\mathbf{20}_i$ by means of a pump $\mathbf{21}_i$ through a component stock feed pipe $\mathbf{23}_i$ into a feed line 100 between the deaeration tank 200 and a first pump 110 in the main line of the process. The first pump 110 in the main line directs or feeds the stock through a screen 115 and through a centrifugal cleaner 120 to the suction side of the second pump 130 in the main line. The second pump 130 in the main line feeds the stock through the machine screen 140 into the headbox 150. The white water recovered from the wire section 160 is fed by means of a circulation water pump 170 into the deaeration tank 200. Any excess white water is passed by means of an overflow $F_{40}$ to atmospheric pressure.

In the deaeration tank 200, there could be an air space subjected to a vacuum above the free surface of the stock to thereby cause the removal of air from the white water. Also, in the screen 115, for example, shivers and debris can be removed from the stock, and in a centrifugal cleaner 120, for example, sand and other particles heavier than fibers can be removed from the stock.

The component stocks $M_i$ are metered from component stock chests $\mathbf{20}_i$ precisely to the mixing volume of the stocks in the dilution water feed pipe 100 coming from the deaeration tank 200. The dilution water feed pipe 100 defines a closed space in which the component stocks $M_i$ are mixed and diluted with the flow of dilution water from the deaeration tank 200 (the deaerated white water constituting the dilution water in this case). The precise, substantially constant pressure of the component stock to be metered is produced so that the surface level and the consistency in the component stock chest $\mathbf{20}_i$ are kept substantially constant and so that a substantially constant back pressure is arranged at the mixing point of the component stocks $M_i$. A precise, constant pressure of the mixing volume is produced so that a sufficient reduction in pressure occurs between the nozzle of the component stock $M_1$ and the mixing volume, in which case, changes of pressure in the mixing volume do not interfere with the metering. The mixing volume is comprised of the dilution water feed pipe 100 passing to the first feed pump 110, the feed pipes $\mathbf{23}_i$ of the metering pumps $\mathbf{21}_i$ and connection arrangements between them.

The diluting of the stock is carried out in two stages. The dilution of the first stage is carried out at the suction side of the first pump 110 in the main line when the component stocks $M_i$ are fed into the feed line 100 between the deaeration tank 200 and the first pump 110 in the main line. In the deaeration tank 200, the surface level is kept substantially constant by means of a surface level controller of the primary side (not shown in FIG. 2), which controls the speed of rotation of the circulation water pump 170. The flow into the feed line 100 takes place with a ram pressure at a constant pressure, in which case, the feed pressure of the dilution water flow $F_{10}$ remains constant. This secures a substantially constant back pressure for the component stocks $M_i$ when they are fed into the feed line 100. By means of the first pump 110 in the main line, a substantially constant volume is pumped constantly to stock cleaning 115, 120 and to the dilution of the second stage.

The dilution in the second stage is carried out at the suction side of the second feed pump 130 in the main line, to which suction side a second dilution water flow $F_{20}$ of substantially constant pressure is passed with a ram pressure from the deaeration tank 200. The regulation of the pressure in the headbox 150 controls the speed of rotation of the second feed pump 130 in the main line.

Further, a third dilution water flow $F_{30}$ is fed from the deaeration tank 200 to the dilution headbox 150 by means of a dilution water feed pump 180 through a screen 190. By means of this third dilution water flow $F_{30}$ passed into the dilution headbox 150, the stock consistency is profiled in the cross direction of the paper machine.

Figure 3:
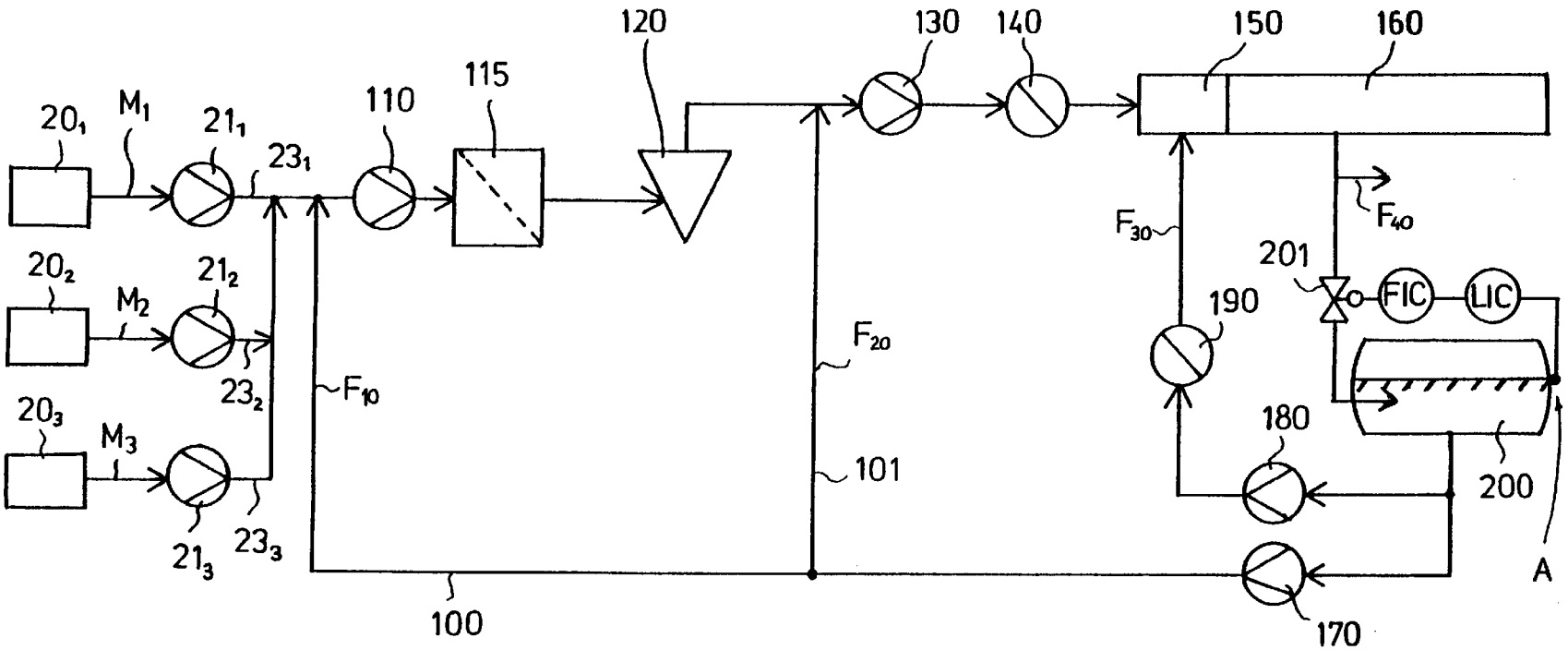
FIG. 3 shows a modification of the process arrangement shown in FIG. 2.

FIG. 3 illustrates a modification of the process arrangement shown in FIG. 2, in which modification, the deaeration tank 200 is situated below the wire section 160. In such a case, the white water can be passed from the wire section 160 directly by means of ram pressure into the deaeration tank 200. From the deaeration tank 200, the dilution water (white water from which air is removed) is fed by means of the circulation water pump 170 into the first $F_{10}$ and second $F_{20}$ dilution stages in the main line of the process. Further, into the dilution headbox 150, a third dilution water flow $F_{30}$ is optionally fed by means of a dilution water feed pump 180 through a screen 190. In the first $F_{10}$ and second $F_{20}$ dilution water flows, a substantially constant pressure can be maintained by means of regulation of the speed of rotation of the circulation water pump 170 and/or by means of throttles in the feed lines 100, 101. Also in this case, there is an overflow $F_{40}$ between the wire section 160 and the deaeration tank 200, from which overflow any excess white water is passed to atmospheric pressure. From the deaeration tank 200, the surface level is measured at the point A, and by means of the surface level controller LIC, the flow controller FIC is controlled, which controls a valve 201 provided in the line passing from the wire section 160 to the deaeration tank 200. In this manner, the surface level in the deaeration tank 200 is maintained at a substantially constant level.

Figure 4:
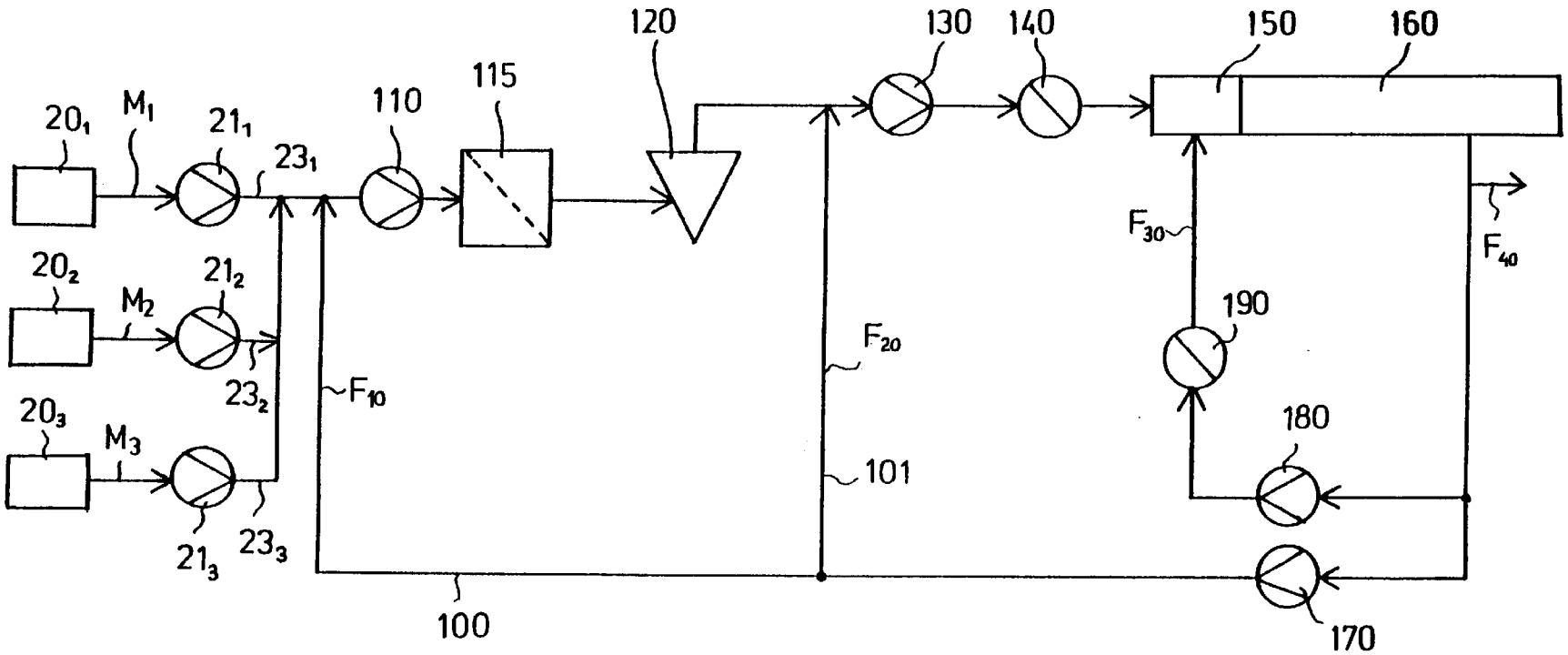
FIG. 4 shows a second modification of the process arrangement shown in FIG. 2.

FIG. 4 shows a second modification of the process arrangement shown in FIG. 2, in which modification, the deaeration tank 200 has been removed completely. In such a case, the headbox 150 and the wire section 160 must be closed so that the stock does not come into contact with the surrounding air. The white water collected from the closed wire section 160 is then fed directly, by means of the circulation water pump 170, into the first $F_{10}$ and second $F_{20}$ dilution stages in the main line of the process.

The method in accordance with the invention for maintaining the surface level and consistency in the stock chest at constant values can, of course, also be applied in connection with the process arrangements illustrated in FIGS. 3 and 4.

FIGS. 2–4 illustrate arrangements in which a dilution headbox is employed, but the invention can also be applied in connection with a headbox of a different sort. In such a case, a second circulation water pump 180 and a related screen 190 would not be required.

The main line screen 115 and the centrifugal cleaner 120 in the embodiments shown in FIGS. 2–4 can comprise one or more stages.

The first feed pump 110, the screen 115, and the centrifugal cleaner 120 in the main line in the embodiments shown in FIGS. 2–4 can be omitted completely in a situation in which the component stocks $M_i$ have already been cleaned to a sufficiently high level of purity before the stock chests $\mathbf{20}_i$. In such a case, in the main line of the process, only the feed pump 130 and the following machine screen 140 would be needed.

Figure 5:
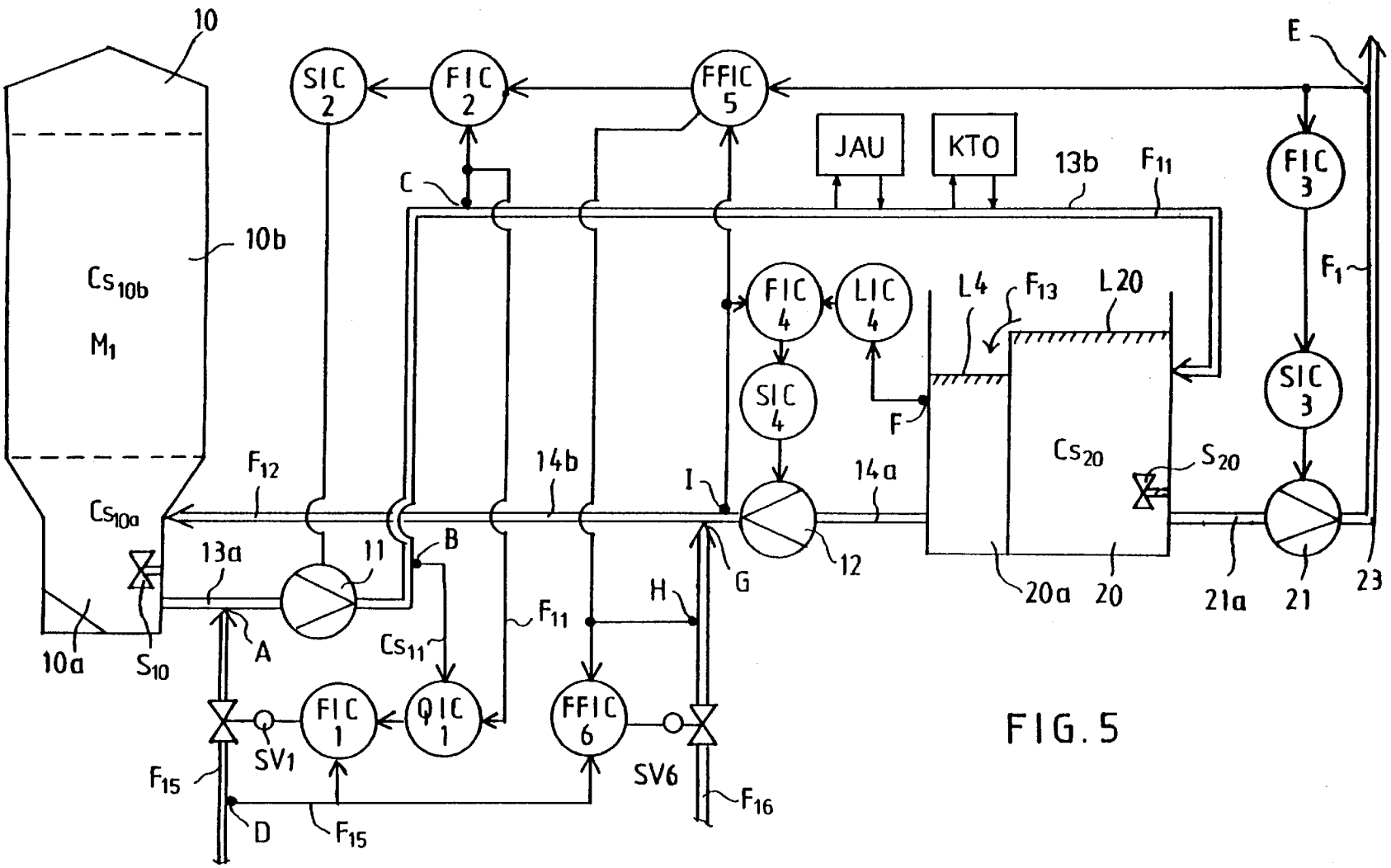
FIG. 5 is a schematic illustration of a process arrangement in accordance with the present invention in which the surface level in the stock chest and the consistency in the stock chest can be maintained at constant values.

FIG. 5 is a schematic illustration of a process arrangement in accordance with the invention by whose means the stock surface level $S_{20}$ in the stock chest 20 and the stock consistency $Cs_{20}$ in the stock chest 20 are regulated. The component stock $M_1$ is fed from a bottom portion 10*a* of the storage tower 10 by means of a first pump 11 as a flow $F_{11}$ into the stock chest 20. From the stock chest 20, component stock is fed by means of a third pump 21 into the main feed line 100 passing into the headbox (FIG. 2, 3 and 4). From the stock chest 20, there is an overflow $F_{13}$ to a pumping tank 20*a*, from which the component stock $M_1$ is fed by means of a second pump 12 as a flow $F_{12}$ into the bottom portion 10*a* of the storage tower 10.

A first dilution water flow $F_{15}$ is fed into the first outlet line 13*a* passing to the suction side of the first pump 11. By means of the dilution water flow $F_{15}$, the stock flow $F_{11}$ fed by means of the first pump 11 from the outlet line 13*a* into the stock chest 20 along the first feed line 13*b* is diluted to the desired consistency. On the other hand, a second dilution water flow $F_{16}$ is directed into a second feed line 14*b* passing from the pressure side of the second pump 12 into the bottom portion 10*a* of the storage tower 10. By means of the dilution water flow $F_{16}$, a constant consistency $Cs_{10a}$ is maintained in the bottom portion 10*a* of the storage tower 10.

The storage tower of the component stock $M_1$ is a large storage tower 10 of, for example, about 1000 cubic meters, in which the consistency $Cs_{10b}$ in the upper portion 10*b* of the column is typically about 10% to about 14%. New stock is fed (not shown in FIG. 5) an the upper portion 10*b* of the storage tower 10, and the consistency $Cs_{10a}$ in the bottom portion 10*a* of the storage tower 10 is lowered to a level of about 4% by means of recirculation of stock and addition of dilution water (not shown. In the bottom portion of the storage tower 10, there is also mixing means such as a first mixing equipment $S_{10}$, by whose means the stock present in the bottom portion 10*a* of the storage tower 10 is maintained at a substantially constant consistency.

The quantity of the stock flow $F_{11}$ pumped by means of the first pump 11 is measured in the first feed line 13*b* at the point C, and this amount is regulated to the desired level by means of a second flow controller FIC2 connected with the first pump 11. This second flow controller FIC2 obtains its set value in a way which will be described later. The second flow controller FIC2 computes the speed of rotation of the first pump 11, and the rev. (revolution) controller SIC2 regulates the speed of rotation of the first pump 11 to the desired level.

In the first feed line 13*b*, at the point B, the consistency of the stock that is fed from the storage tower 10 by means of the first pump 11 into the stock chest 20 is measured. By means of a first consistency controller QIC1, it is possible to control the first flow controller FIC1 directly, by means of which flow controller the first dilution water flow $F_{15}$ to be passed to the suction side of the first pump 11 is regulated. It is also possible to employ a more efficient method in which the first consistency controller QIC1 regulates the ratio of the first dilution water flow $F_{15}$ to the stock flow $F_{11}$ measured in the first feed line 13*b* at the point C and fed by the first pump 11. When the stock flow $F_{11}$ fed by the first pump 11 is changed, the set value of the first flow controller FIC1 is also changed, and the first flow controller FIC1 changes the first dilution water flow $F_{15}$ quickly. Thus, the first consistency controller QIC1 can be tuned to eliminate any variations in consistency coming from the storage tower 10.

The first flow controller FIC1 receives the flow data $F_{15}$ concerning the first dilution water from a measurement point D situated in the feed line of the first dilution water flow and regulates the flow to the desired level by means of a first regulation valve SV1. This regulation eliminates any pressure disturbance occurring in the dilution water line and any problems arising from partial wear of the first regulation valve SV1.

In the stock chest 20, the stock is stirred intensively by mixing means such as a second mixing equipment $S_{20}$ in order that a uniform consistency could be achieved for metering. By means of a third pump 21, the component stock $M_1$ is fed, in the arrangements shown in FIGS. 2, 3 and 4, into the pipe for mixing of component stocks. In particular, a process arrangement in accordance with FIGS. 2, 3 and 4 requires precise metering of the component stock $M_1$ from the stock chest 20. In such a case, all of the stock in the stock chest 20 should have a uniform consistency, and the feed pipe 21*a* departing from the stock chest 20 to the third pump 21 must be at a uniform feed pressure.

The stock level L20 can be maintained at a constant level in the stock chest 20 by means of surface level regulation alone. In such a case, the suction side of the second pump 12 is connected directly to the stock chest 20, and a measurement point F of the fourth level controller LIC4 is placed in the stock chest 20, in which case a pumping tank 20*a* is unnecessary. In such a situation, the fourth level controller LIC4 controls the fourth flow controller FIC4 connected to the second pump 12, which flow controller FIC4 again controls the fourth rev. controller SIC4 connected with the second pump 12. The return flow $F_{12}$ from the stock chest 20 is regulated directly in compliance with the stock surface level L20 in the stock chest 20.

In FIG. 5, the regulation of the surface level in the stock chest 20 is accomplished in a different way. To wit, from the stock chest 20, there is an overflow $F_{13}$ to the pumping tank 20*a*, from which stock is fed by means of the second pump 12 into the bottom portion 10*a* of the storage tower 10. The stock surface level L4 in the pumping tank 20*a* is measured at the point F in the pumping tank 20*a*, and the measurement result can be provided to the fourth surface level controller LIC4, which controls the fourth rev. controller SIC4, by whose means the speed of rotation of the second pump 12 is regulated. In such a case, the surface level L4 of the stock present in the pumping tank 20*a* can be maintained substantially constant.

If the surface level L4 of the stock present in the pumping tank 20*a* is allowed to vary within a certain range, the fourth surface level controller LIC4 can be formed in the following novel manner.

The set value SP4 of the fourth flow controller FIC4 is computed from the formula:

$$SP4=KO+K1*L4 \quad (1)$$

wherein

L4 is the surface level measured in the pumping tank 20*a*, and

KO and K1 are constants.

When the stock level L4 present in the pumping tank 20*a* rises, the exhaust flow increases correspondingly, The stock flow $F_{12}$ produced by the second pump 12 is measured in the second feed line 14*b* at a point I. This measurement data is also fed to the fifth flow controller FFIC 5, which will be described later.

Dilution water is additional directed at a point G into the second feed line 14*b* passing into the bottom portion 10*a* of the storage tower 10 in order to bring the consistency of the stock present in the bottom portion 10*a* of the storage tower 10 to a desired level. This second dilution water flow $F_{16}$ is regulated by means of the second flow controller FIC6 connected with the flow, which controller regulates a sixth regulation valve SV6. A set value SP6 of the sixth flow controller FFIC6 can be computed or determined based on the flow data relating to the first dilution water flow $F_{15}$ and measured at the point D and based on other characteristics representing the process.

The set value SP6 of the sixth flow controller FFIC6 can also be determined in an alternative way by using a ratio control as an aid. If the consistency of the stock pumped by means of the first pump 11 from the bottom portion 10*a* of the storage tower 10 is increased, the first consistency control QIC1 increases the amount of the first dilution water flow $F_{15}$. In order that the consistency in the bottom portion 10*a* of the storage tower 10 could be lowered to the desired level, the second dilution water flow $F_{16}$ must also be increased.

Based on this fact, the set value of the sixth flow controller FIC6 related to the second dilution water flow $F_{16}$ can be computed from the equation:

$$SP6=K1*F(E)+K2*F(D) \quad (2)$$

wherein

K1 and K2 are empiric constants depending on the point of operation,

F(E) is the flow at the point E, and

F(D) is the flow at the point D.

The term K2*F(D) helps the first flow controller FIC1 to remain constantly in the range of operation, and by means of the term K1*F(E), consideration is given to the difference between the amount of water departing from the circulation in the stock metering flow $F_1$ and the amount of water entering into the circulation from the bottom portion 10*a* of the storage tower 10 in the outward stock flow $F_{11}$, the dilution waters included.

The computation or determination of the set value of the second flow controller FIC2 takes place in the fifth flow controller FFIC5 in the following manner:

The set value SP2 of the stock flow $F_{11}$ fed by means of the pump 11 from the bottom portion 10*a* of the storage tower 10 into the stock chest 20 at the point C is computed by means of the equation:

$$SP2=K1+F(E)$$

wherein

F(E) is the metering flow $F_1$ measured at the point E, and

K1 is a correction term.

K1 can be constant, in which case the outward flow $F_{11}$, produced by the first pump 11 into the stock chest 20 is constantly higher by the constant than the metering flow $F_1$ removed by the third pump 21 from the stock chest 20. In this situation, the second pump 12 returns any excess stock into the storage tower 10.

The correction term $K_1$ mentioned above can also be defined, for example, in accordance with the following equation:

$$K1_n=K1_{n-1}+K2*(FSP(I_n)-F(I_n))$$

wherein

FSP(I) is the set value of the return flow $F_{12}$ at the point I, and

F(I) is the factual measured return flow $F_{12}$ at the point I.

In a situation in which the measured flow value of the stock flow $F_{12}$ produced by the second pump 12 is lower than the corresponding set value, the set value SP2 of the first pump 11 is increased, and in a contrary case it is reduced. By means of this arrangement, it is possible to take into account an increase or reduction of stock flow occurring in the outward stock flow $F_{11}$, for example, in connection with recovery of fibers, which increase or reduction is unknown from the point of view of the control circuit, so that the stock return flow $F_{12}$ fed by the second pump 12 remains at the desired value. If the return flow $F(I_n)$ of the second pump 12 measured at the point I is higher than the set value $FSP(I_n)$ of the return flow of the second pump 12, the correction term K1 reduces the stock flow $F_{11}$ fed by the first pump 11 until an equilibrium is reached, and vice versa.

In the embodiment described above, at the pumps 11, 12 and 13, regulation of the speed of rotation is employed in order to regulate the stock flows $F_{11}$, $F_{12}$ and $F_1$ produced by the pumps. Instead of regulation of the speed of rotation, for regulation of the stock flows, it is possible to use a regulation valve arranged in connection with each pump. In such a case, the pump revolves at a constant speed, and the stock flow is regulated by means of a regulation valve, by whose means the stock flow can be throttled. It is also possible to employ both regulation of the speed of rotation of a pump and a regulation valve in order to regulate the stock flows.

In FIG. 5, an allusion has also been made to a possible connection of the outward flow $F_{11}$ with grinding JAU and recovery of fibers KTO. In grinding, a component stock that is supposed to be ground is passed through a grinder, after which it returns to the first feed line 13*b*. The same flow that passes to the grinders returns from the grinders. In recovery of fibers, a component stock, e.g., cellulosic pulp, circulates in recovery of fibers, in which it can be bound with fibers, ashes and fines recovered from zero water by means of a disk filter. In such a case, the flow passing to the recovery of fibers and the flow returning from the recovery to the first feed line 13*b* are not necessarily equally large.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

I claim:

1. A method for regulating a surface level and consistency of stock in a stock chest, comprising the steps of:

directing a flow of component stock from a bottom portion of a storage tower into the stock chest, regulating the consistency of the component stock that is fed from the storage tower to the stock chest by directing a variable first flow of dilution water into the flow of component stock before the flow of component stock enters into the stock chest to thereby dilute the component stock, mixing the component stock in the stock chest to thereby provide the component stock with a uniform consistency in the stock chest, controlling the surface level of stock in the stock chest by directing an adjustable amount of stock removed from the stock chest as a return flow into the bottom portion of the storage tower to mix with the component stock in the storage tower, regulating the consistency of the return flow of the component stock, that is fed from the stock chest to the storage tower, by directing a variable second flow of dilution water into the return flow of the component stock before the return flow of the component stock enters into the storage tower, and mixing the component stock in the bottom portion of the storage tower to thereby provide the component stock with a uniform consistency in the bottom portion of the storage tower.

2. The method of claim 1, wherein the step of controlling the surface level in the stock chest further comprises the step of:

arranging a pumping tank to receive overflow from the stock chest, and pumping the adjustable amount of stock from the pumping tank into the storage tower via a pump.

3. The method of claim 1, wherein the surface level in the stock chest is controlled to be substantially constant.

4. The method of claim 1, wherein the step of directing the flow of component stock from the bottom portion of the storage tower in the stock chest comprises the steps of:

passing the component stock from the bottom portion of the storage tower into an outlet line, and arranging a pump to receive the component stock from the outlet line and direct the component stock through a feed line into the stock chest.

5. The method of claim 4, wherein the step of directing the first flow of dilution water into the flow of component stock comprises the step of:

directing the first flow of dilution water into the outlet line.

6. The method of claim 1, further comprising the steps of:

measuring the consistency of the diluted component stock before the stock chest, and regulating the first flow of dilution water being directed into the flow of component stock based on the measured consistency.

7. The method of claim 1, further comprising the steps of:

arranging a pump to direct the mixed flow of component stock and first flow of dilution water into the stock chest, measuring the consistency of the diluted component stock after the pump and before the stock chest, measuring a flow property of the diluted component stock after the pump and before the stock chest measuring a flow property of the first flow of dilution water before the first flow of dilution water is directed into the flow of component stock, and regulating the first flow of dilution water being directed into the flow of component stock based on the measured consistency and flow property of the diluted component stock and the measured flow property of the first flow of dilution water.

8. The method of claim 1, further comprising the steps of:

measuring a flow property of the first flow of dilution water before the first flow of dilution water is directed into the flow of component stock, and regulating the first flow of dilution water into the flow of component stock based on the measured flow property of the first flow of dilution water.

9. The method of claim 1, further comprising the steps of:

measuring a flow property of the first flow of dilution water before the first flow of dilution water is directed into the flow of component stock, arranging a pump to pump stock from the stock chest to a short circulation of a paper machine, measuring the flow of the stock being pumped from the stock chest to the short circulation of the paper machine, and regulating the second flow of dilution water based on the measured flow property of the first flow of dilution water and the measured flow property of the stock being pumped from the stock chest to the short circulation of the paper machine.

10. The method of claim 9, wherein the second flow of dilution water is regulated in consideration of any difference between an amount of water in the stock being pumped from the stock chest to the short circulation of the paper machine and an amount of water entering into the stock chest in the mixed flow of component stock and first flow of dilution water.

11. The method of claim 1, further comprising the steps of:

arranging a pump to pump stock from the stock chest to a short circulation of a paper or board machine, measuring the flow of the stock being pumped from the stock chest to the short circulation of the paper machine after the pump, and regulating the flow of component stock from the bottom portion of the storage tower to be larger than the measured flow of stock from the stock chest by a substantially constant amount.

12. The method of claim 11, further comprising the step of:

measuring a flow property of the return flow, the flow of stock from the storage tower being regulated by a flow controller in accordance with a set value determined from the equation:

$$SP2=K1+F(E),$$

wherein

F(E) is the measured flow of stock from the stock chest to the short circulation of the paper machine, and $K_1$ is a correction term based on the measured flow property of the return flow.

13. The method of claim 1, wherein the step of controlling the surface level in the stock chest further comprises the steps of:

arranging a pumping tank to receive overflow from the stock chest, the return flow of stock from the stock chest being directed from the pumping tank into the storage tower, measuring the surface level of stock in the pumping tank, and regulating the return flow of stock from the pumping tank into the bottom portion of the storage tower based on the measured surface level of stock in the pumping tank such that the surface level of stock in the pumping tank is maintained substantially constant.

14. The method of claim 1, wherein the step of controlling the surface level in the stock chest further comprises the step of:

arranging a pumping tank to receive overflow from the stock chest, the return flow of stock from the stock chest being directed from the pumping tank into the storage tower, measuring the surface level of stock in the pumping tank, and regulating the return flow of stock from the pumping tank into the bottom portion of the storage tower by means of a flow controller in accordance with a set value determined from the equation:

$$SP4=KO+K1*L4$$

wherein L4 is the measured surface level of stock in the pumping tank and KO and $K_1$ are constants, whereby when the surface level of stock in the pumping tank rises, the return flow increases and when the surface level of stock in the pumping tank decreases, the return flow is reduced.

15. The method of claim 1, wherein the component stock is directed from the stock chest into a short circulation of a paper or board machine.

16. The method of claim 1, further comprising the steps of:

arranging a pump to direct the component stock from the storage tower to the stock chest, the first flow of dilution water being directed into the component stock prior to the pump, and regulating the first flow of dilution water being directed into the component stock to thereby enable regulation of the consistency of the stock in the stock chest.

17. The method of claim 1, wherein the surface level of stock in the stock chest is controlled by arranging a level controller to receive a measurement of the surface level of stock in the stock chest, arranging a pump to control the return flow and operating the level controller to control the pump.

18. A method for regulating a surface level and consistency of stock in a stock chest, comprising the steps of:

directing a flow of the component stock from a bottom portion of a storage tower into the stock chest, regulating the consistency of the component stock that is fed from the storage tower to the stock chest by directing a variable first flow of dilution water into the flow of component stock before the flow of component stock enters into the stock chest to thereby dilute the component stock, mixing the component stock in the stock chest to thereby provide the component stock with a uniform consistency in the stock chest, arranging a pumping tank to receive overflow from the stock chest such that the surface level of stock in the stock chest is maintained at a substantially constant level, directing an amount of the stock from the pumping tank as a return flow into the bottom portion of the storage tower to mix with the component stock in the storage tower, regulating the consistency of the return flow of the component stock that is fed from the stock chest to the storage tower by directing a variable second flow of dilution water into the return flow the component stock before the return flow of the component stock enters into the storage tower, and mixing the component stock in the bottom portion of the storage tower to thereby provide the component stock with a uniform consistency in the bottom portion of the storage tower.

19. The method of claim 18, wherein the step of directing the flow of component stock from the bottom portion of the storage tower in the stock chest comprises the steps of:

passing the component stock from the bottom portion of the storage tower into an outlet line, and arranging a pump to receive the component stock from the outlet line and direct the component stock through a feed line into the stock chest, the step of directing the first flow of dilution water into the flow of component stock comprising the step of:

directing the first flow of dilution water into the outlet line.

20. The method of claim 18, further comprising the steps of:

measuring the consistency of the diluted component stock before the stock chest, and regulating the first flow of dilution water being directed into the flow of component stock based on the measured consistency.

21. The method of claim 18, further comprising the steps of:

arranging a pump to direct the mixed flow of component stock and first flow of dilution water into the stock chest, measuring the consistency of the diluted component stock after the pump and before the stock chest, measuring a flow property of the diluted component stock after the pump and before the stock chest measuring a flow property of the first flow of dilution water before the first flow of dilution water is directed into the flow of component stock, and regulating the first flow of dilution water being directed into the flow of component stock based on the measured consistency and flow property of the diluted component stock and the measured flow property of the first flow of dilution water.

22. The method of claim 18, further comprising the steps of:

measuring a flow property of the first flow of dilution water before the first flow of dilution water is directed into the flow of component stock, and regulating the first flow of dilution water being directed into the flow of component stock based on the measured flow property of the first flow of dilution water.

23. The method of claim 18, further comprising the steps of:

measuring a flow property of the first flow of dilution water before the first flow of dilution water is directed into the first flow of component stock, arranging a pump to pump stock from the stock chest to a short circulation of a paper machine, measuring the flow of stock from the stock chest to the short circulation of a paper machine after the pump, and regulating the second flow of dilution water being directed into the return flow of stock based on the measured flow property of the first flow of dilution water and the measured flow of stock from the stock chest to the short circulation of a paper machine.

24. The method of claim 23, wherein the second flow of dilution water is regulated in consideration of any difference between an amount of water in the stock being directed from the stock chest to the short circulation of a paper machine and an amount of water entering into the stock chest in the diluted flow of component stock.

25. The method of claim 18, further comprising the steps of:

arranging a pump to pump stock from the stock chest to a short circulation of a paper or board machine, measuring the flow of stock from the stock chest to the short circulation of a paper machine after the pump, and regulating the first flow of component stock from the bottom portion of the storage tower to be larger than the measured flow of stock from the stock chest to the short circulation of a paper machine by a substantially constant amount.

26. The method of claim 25, further comprising the step of:

measuring a flow property of the return flow, the flow of stock from the storage tower being regulated by a flow controller in accordance with a set value determined from the equation:

$$SP2=K1+F(E),$$

wherein F(E) is the measured flow of stock from the stock chest to the short circulation of the paper machine, and $K_1$ is a correction term based on the measured flow property of the return flow.

27. The method of claim 18, further comprising the steps of:

measuring the surface level of stock in the pumping tank, and regulating the return flow of stock from the pumping tank into the bottom portion of the storage tower based on the measured surface level of the pumping tank such that the surface level of stock in the pumping tank is maintained substantially constant.

28. The method of claim 18, further comprising the steps of:

measuring the surface level of stock in the pumping tank, and regulating the return flow of stock from the pumping tank into the bottom portion of the storage tower by a flow controller in accordance with a set value determined from the equation:

$$SP4=KO+K1*L4$$

wherein L4 is the measured surface level of stock in the pumping tank and KO and $K_1$ are constants, whereby when the surface level of stock in the pumping tank rises, the return flow increases and when the surface level of stock in the pumping tank decreases, the return flow is reduced.

29. The method of claim 18, wherein the diluted component stock is directed from the stock chest into a short circulation of the paper or board machine.

* * * * *